US005082317A

United States Patent [19]

Delaney, Jr.

[11] Patent Number: 5,082,317

[45] Date of Patent: Jan. 21, 1992

[54] SELF-ADJUSTING DOOR STOP AND CATCH

[76] Inventor: Robert G. Delaney, Jr., 210 Broadmoor Blvd., Lafayette, La. 70503

[21] Appl. No.: 658,049

[22] Filed: Feb. 20, 1991

[51] Int. Cl.[5] ..... E05C 17/56

[52] U.S. Cl. ..... 292/251.5; 292/DIG. 19

[58] Field of Search ..... 292/DIG. 19, 251.5; 16/86 C, 86 R

[56] References Cited

U.S. PATENT DOCUMENTS

| | | | |
|---|---|---|---|
| 3,025,559 | 3/1962 | Basinger | 292/251.5 |
| 3,055,689 | 9/1962 | Jorgensen | 292/DIG. 19 |
| 3,163,453 | 12/1964 | Stephens | 292/251.5 |
| 3,244,443 | 4/1966 | Rodgers | 292/251.5 |
| 3,258,285 | 6/1966 | Smith | 292/251.5 |
| 3,261,631 | 7/1966 | Alessi | 292/251.5 |
| 3,300,239 | 1/1967 | Dinkin | 292/251.5 |
| 3,701,557 | 10/1972 | Centofante | 292/DIG. 19 |
| 4,505,502 | 3/1985 | Tomita | 292/251.5 |
| 4,669,766 | 6/1987 | Hanchett, Jr. et al. | 292/251.5 |
| 4,702,506 | 10/1987 | Iimura | 292/251.5 |

*Primary Examiner*—Gary L. Smith
*Assistant Examiner*—Darnell M. Boucher
*Attorney, Agent, or Firm*—William W. Stagg

[57] ABSTRACT

A magnetic door stop and catch has a helically coiled spring mounted on a base board or wall through which a flexible cable extends to hold a swivel mounted magnet at the end of the spring. The magnet is pivotly mounted at the swivel which allows 360 degrees rotation and deflection of the magnet in all directions as the magnet engages a magnetically attractable strike plate mounted to a door opposite the door stop.

12 Claims, 2 Drawing Sheets

SELF-ADJUSTING DOOR STOP AND CATCH

FIELD OF INVENTION

The present invention relates generally to magnetic door stops and, more particularly, is concerned with a new and improved magnetic door stop and catch that is self-adjusting in all directions to the angle necessary to hold the door.

BACKGROUND OF INVENTION

The use of magnetic door stops to catch and hold doors in a fixed position is known. They generally work by mounting a magnet to the door which engages a magnetically attractable strike plate on the wall or floor to secure the door in place. The principal problem associated with the use of magnetic door stops has been misalignment of the magnetic door stop and strike plate due to room maintenance, door sagging, design and construction defects and continued use. A number of attempts have been made to solve these problems.

U.S. Pat. No. 3,258,285 to R.K. Smith teaches a spring biased magnet slidably mounted in a non-magnetic tube. The magnet is retracted in the non-magnetic tube until it is in direct proximity of a second magnet fixed in a floor or wall. The magnetic attraction overcomes the pull of the spring withdrawing the slidably mounted magnet from the non-magnetic tube to secure the door. The disadvantage of the Smith patent is that the wall or floor magnets must be directly aligned with the slidably mounted door magnet to release holder. There is no self-adjusting mechanism to compensate for misalignment, door sag or the like.

U.S. Pat. No. 4,505,502 to Rioe Tomita teaches a device having a magnetically attractable strike plate housed in a conical shaped cylinder. The strike plate is cushioned to absorb some of the force of the door as it bumps against the stop as well as to provide some flexibility in alignment of the strike plate with the magnetic stop. The disadvantage of the Tomita stop and catch is that there is no direct load transfer between the magnet and the strike plate. The transfer of load is indirect through the strike plate housing.

U.S. Pat. No. 3,244,443 to M. E. Rodgers illustrates a stop and catch having a plastic shank with a permanent magnet housed at one end to catch a fixed mounted strike plate. Manual adjustments for door tilt are achieved by bending the resilient plastic shank. There is no feature for self-alignment of the stop.

U.S. Pat. No. 4,669,766 to L. J. Hanchett, Jr., et al attempts to solve the problem of alignment by teaching a device with an arcuately slidable electromagnet that can be adjusted to proper alignment and then locked in place. There is no feature for self-alignment and the device must be periodically readjusted to account for door sag or incidental movement during maintenance or door usage.

U.S. Pat. No. 3,025,559 to J. W. Basinger discloses a helical coiled spring with a magnet at its end to engage a strike plate. It has no provision for deflection or rotation of the magnet face. The tension load from the magnet is tranferred directly through the spring to the wall base.

U.S. Pat. No. 3,701,557 to Centofante and U.S. Pat. No. 3,300,239 to Dinkin teach magnetic door stops and holders with relatively movable holding magnets. In Centofante the relative movement is limited to a 180 degree pivot in a single plane and the device is manually adjustable for the door angle. In Dinkin the relative movement is accomplished by a helically coiled spring shaft mounted at one end to a wall and an axial mounted stud at the other end of the shaft projecting outward to hold a magnetic disk. The magnetic disk has a central bore with a diameter greater than the stud diameter. This diameter difference allows the disk to move or have "play" in all directions for door alignment. In Centofante there is relative and thus adjustment in only one plane with no means for self-alignment. In Dinkin while there is relative movement and thus self-adjustment capability in all directions, there is no means to buffer or cushion the relative movements on impact of the door and stop.

The present invention is intended to solve the problem of misalignment of door stop and strike plate as well as to accommodate the use of the door stop where doors and walls are non-parallel by providing a multi-directional self-adjusting door stop and catch.

Another object of the invention is to provide a door catch and stop that is self adjusting so that it need not be manually readjusted when the stop is bumped or knocked during use or during maintenance of the room.

Another object of the invention is to provide a direct load transfer from the magnet to the base plate of the stop.

Another object of the invention is to provide a means to adjust the position of the magnet to contact the strike plate in a manner to increase the magnetic holding power of the door catch.

SUMMARY OF INVENTION

The present invention provides a door stop and catch designed to satisfy the aforementioned needs. The invention embodies a unique mounting for the magnet that allows 360 degree rotation of the magnet to adjust and readjust the position of the magnet as it meets the strike plate. This position adjustment allows the user to maximize the holding force of the magnet to accommodate door and magnet misalignment due to maintenance, installation, door sagging and general usage. The unique mounting also allows for self alignment of the door strike plate and the magnetic door stop to accommodate various door/wall angles. Furthermore, the invention is esthetically similar to conventional non-magnetic door steps and easy to install.

Accordingly, the present invention relates to an apparatus for magnetically stopping and holding open a door, which includes a base plate, a helically coiled spring mounted to the base plate at one end, a flexible cable also mounted to the base plate running through the center of the helically coiled spring which is connected to a swivably mounted wire magnet mount rotatably pinned to a magnet at the other end of the helically coiled spring. The magnet, magnet mount and helically coiled spring is slidably mounted within a non-magnetic tube and cushioned by a foam wrap that allows angular rotation in all directions to facilitate magnet contact with a strike plate.

DESCRIPTION OF THE PREFERRED EMBODIMENTS

Figure 1:
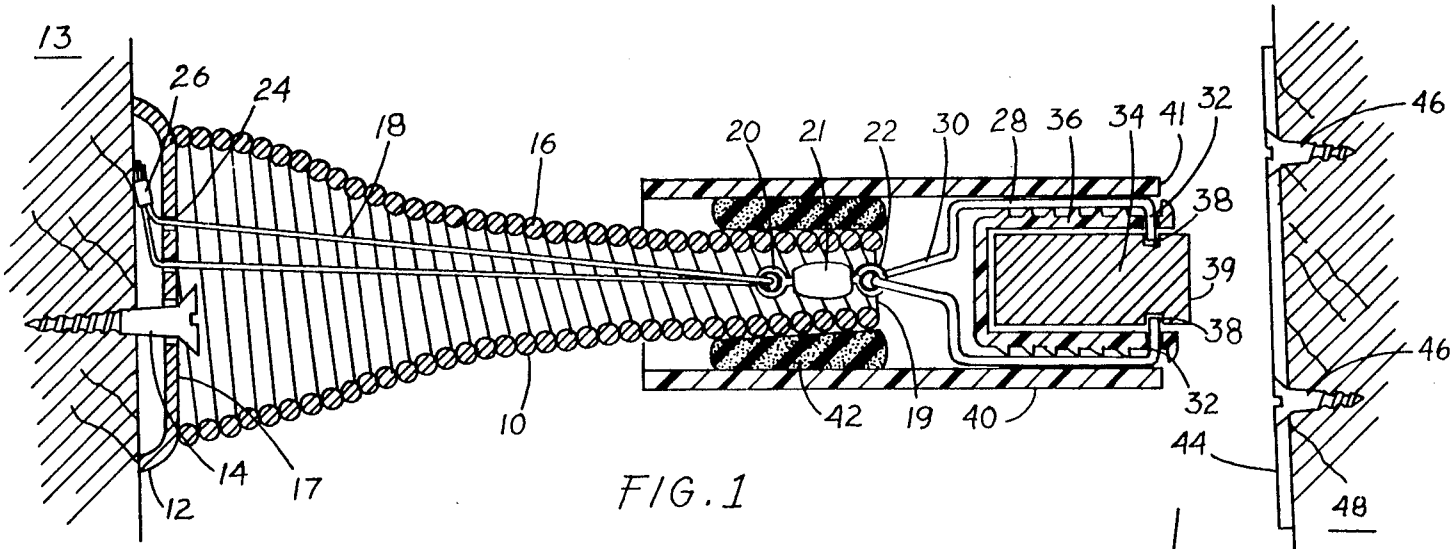
FIG. 1 is a cross-sectional of the invention.

Referring now to the drawings and more particularly to FIG. 1, there is shown the preferred embodiment of an improved magnetic door stop generally designated 10. The door stop 10 includes a base plate 12 mounted to a wall 13 by a screw 14. Other means for mounting the base plate to the wall such as nails, glue and the like may be utilized. Screwably mounted to the base plate 12 is a helically coiled spring 16 having a base plate end 17 and a distal projecting end 19. A flexible cable or cord 18 runs longitudinally through the longitudinal bore of the coiled spring 16 and is looped through one eye 20 of a two-eyed swivel connector 21 having eyes 20 and 22. Other flexible load transfer means such as a chain, cord, elastic bands, wire or any other flexible material may be used.

The swivel connector 21 is similar to those types of connectors used with fishing tackle and allows each eye, 20 and 22, to spin in a 360 degree circle about the centerline of the connectors. The flexible cable 18 is inserted through cable holes 24 in the base plate 12 and clamped with a metal crimp 26. The length of the cable 16 is not critical but should be of sufficient length to allow the swivel connector 21 to extend just at or below the distal projecting end 19 of the spring 16.

A rectangular U-shaped wire magnet mount 28 having a notched end 30 at the base and a pair of mounting pins 32 on the tines is looped through the second eye 22 of the swivel connector 21 so that the notched end 30 of the magnet mount 28 is centered in the swivel eye 22. A cylindrically shaped magnet 34 having a magnet face 39 and a plastic outer casing 36 and pin holes 38 that are bored through the outer casing 36 and into the magnet 34 is attached to the magnet mount 28 by the mounting pins 32 that are placed into the magnet pin holes 38. The insertion of the mounting pins 32 into the pinholes 38 allows the magnet 34 to pivot about the pins. A cylindrical shaped metal sandwiched ceramic type magnet is preferable though other types of magnets may be utilized.

A non-magnetic tube 40 having an inside diameter approximately the same as the width of the wire magnet mount 28 and a length about one-half that of the coiled spring is pushed over the wire magnet mount 28 and magnet 34 and partially over coiled spring 16 to a point where the magnet 34 and thus the magnet face 39 is slightly protruding from the end 41 of the tube 40. The tube 40 is held in place by the friction of the mounting pin against the inside wall of the tube 40. This tube 40 helps to keep the mounting pins 32 of the magnet mount 28 secured within the pin holes 38 of the magnet 34. The pins 32 of the magnet mount 28 are also pushed into the pin holes 38 by the flexing of the wire mount as tension is placed on the magnet 34 and flexible cable or cable 18 during use.

The non-magnetic tube 40 is further held in position by a foam wrapping 42 that aids in centering the tube 40 around the coiled spring 16. The foam wrapping 42 dampens the angular movement of the tube 40 and correspondingly the angular movement of the magnet 34 in all directions.

Also shown is a magnetically attractable strike plate 44 mounted by screws 46 to a door 48. In use the door stop 10 is attached to the wall 13 by the set screws 14. The magnet 34 of the door stop 10 is adjusted so that it is slightly protruding from the end 41 of the tube 40 to expose the magnet face 39. The strike plate 44 is attached to the door opposite the door stop 10 by screws 46. When the door is opened in proximity of the door stop 10, the magnet face 39 of the magnet 34 is attracted to the strike plate 44 and the door is held in place.

The tension load from the pull of the magnet 34 on the strike plate 44 is transferred from the magnet 34 to the wire magnet mount 28, the swivel 21, the cable or cord 18 to the base plate 12. There is no tension load transfer in the helically coiled spring.

The magnetic pull of the magnet 34 against the strike plate 44 can be adjusted as desired by rotating the tube 40 and thus the magnet 34 about its centerline axis. This rotation is possible because of the swivel connector 21 and the cable or cord 18. If the door stop is bumped or hit and misaligned during room maintenance or room use, the tube 40 and thus the magnet 34 is simply rotated to reposition the magnet face 39 on the strike plate 44 until a satisfactory amount of magnetic pull against the strike plate 44 is achieved.

Because of the flexibility of the spring 16 and the pin 32 to pin hole 38 magnet mounting the door stop is capable of achieving angular deflection of the tube 40 and magnet 34 in all directions. The door stop 10 and strike plate 44 need not be perpendicular to each other for the door catch to function. The angular deflection of the tube 40 and the magnet 34 allows self-adjusting of the magnet face 39 to engage the strike plate 44 in a parallel fashion.

Figure 2:
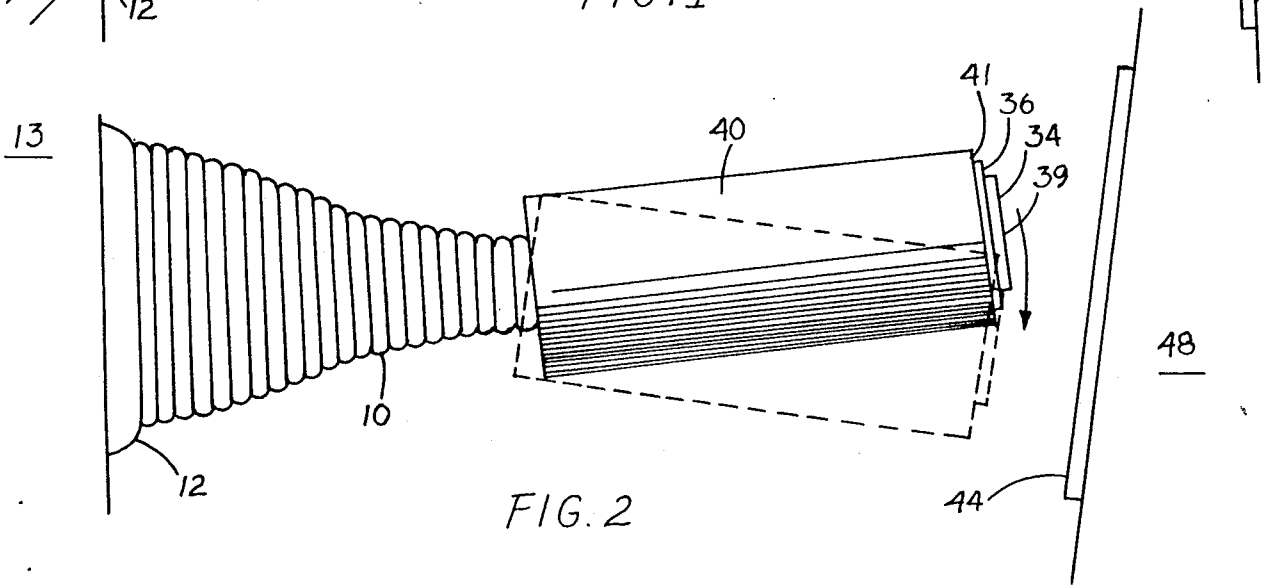
FIG. 2 is a plan view of the invention of FIG. 1 shown in use.
Figure 3:
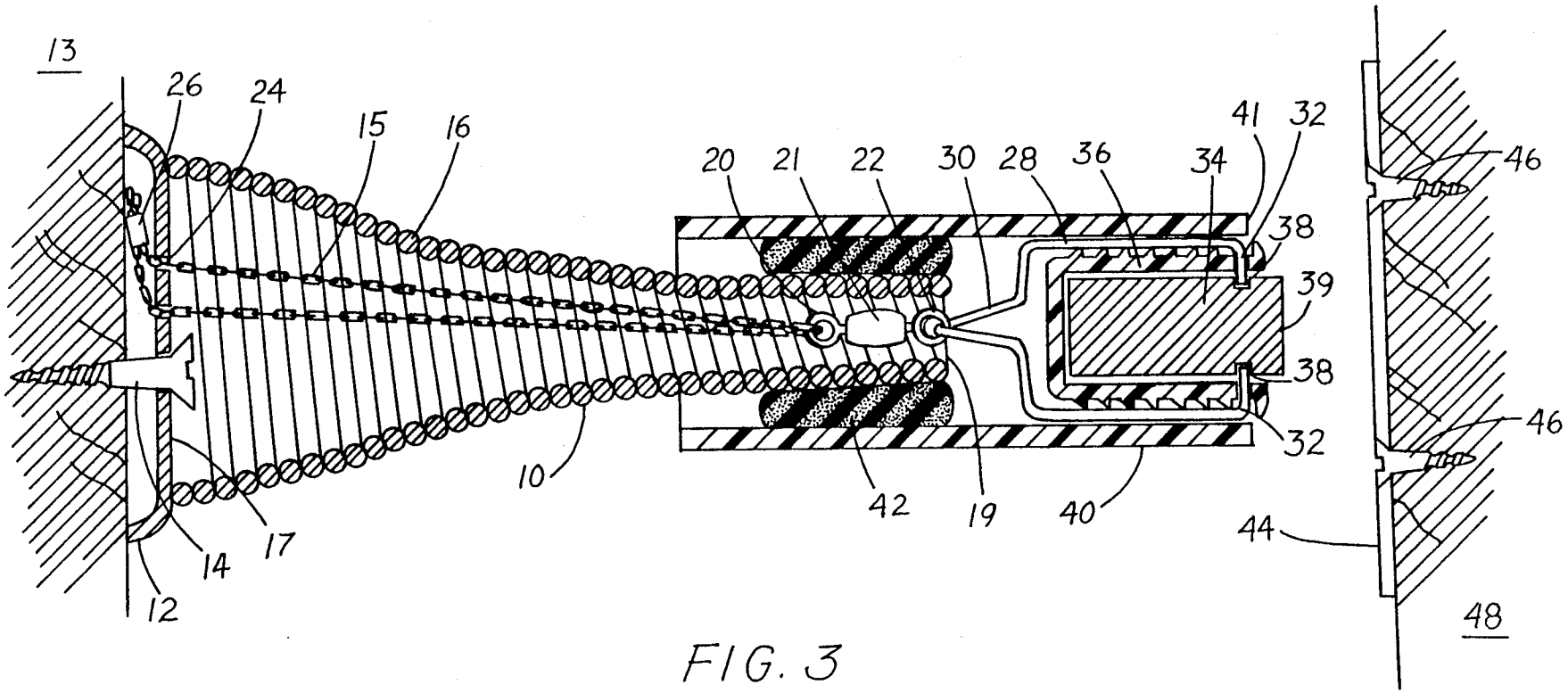
FIG. 3 is a cross-section of the invention where the transferring means is a chain 15.

FIG. 2 shows the door stop 10 is use. The door stop 10 is mounted to a wall 13. On the door 48 opposite the door stop 10 is a strike plate 44. The door stop 10 and the strike plate 44 are shown at an oblique angle. The angular deflection of the magnet 34 due to the pinned magnet mount 28 the spring 16 and the tube 40 dampened by the foam 42 allows the magnet 34 to self-adjust to position the magnet face 39 parallel to the strike plate 44. This angular deflection is illustrated in the figure by the arrow showing the variable deflection of the tube 40 and the magnet 34. The door stop 10 as illustrated and described shows the self-adjusted deflection angle of the magnet 34 and tube 40 as the magnet face 39 approaches the strike plate 44 to achieve contact. The position of the door stop 10 and the strike plate 44 may be reversed. That is the door stop 10 may be mounted on the door and the strike plate 44 may be mounted on the wall and a similar result may be obtained.

It is thought that the self-adjusting door stop and catch and many of its intended advantages will be understood from the foregoing description and it will be apparent that various changes may be made in form, construction, and arrangement of the parts thereof without departing from the spirit and scope of the invention or sacrificing all of its material advantages, the form herein before described being merely illustrative of the preferred embodiment of the invention.

I claim:

1. A self-adjusting magnetic door stop and catch, comprising:

(a) a base plate mounted to a wall;

(b) a spring mounted to and projecting from said base plate, said spring having a plurality of helical coils around a longitudinal bore;

(c) a flexible load transferring means mounted to said base plate and extending through the longitudinal bore of said spring;

(d) a non-magnetic tube slidably positioned over the projecting portion of said spring;

(e) a magnet positioned within and protruding from said tube;

(f) means for connecting said magnet to said flexible load transferring means at the projecting end of said spring so that said magnet rotates about the longitudinal centerline of said spring; and (g) a magnetically attractable plate mounted to a door opposite said magnet so as to attract and engage said magnet so as to hold said door in an open position.

2. A door stop and catch as recited in claim 1 wherein said flexible load transferring means is a cable.

3. A door stop and catch as recited in claim 2 wherein said means for connecting said magnet to said cable so that said magnet rotates includes a swivel mounted between said cable and said magnet.

4. A door stop and catch as recited in claim 3 wherein said magnet is cylindrically shaped, said cylindrically shaped magnet having a pair of bore holes opposite one another.

5. A door stop and catch as recited in claim 4 wherein said means for attaching said magnet to said cable includes a U-shaped wire mount having a pair of projecting tines rotatably mounted to said swivel, said tines having inwardly projecting pins for insertion into said bore holes of said magnet.

6. A door stop and catch as recited in claim 5 further comprising a foam pad mounted to said spring between said spring and said tube so as to dampen angular deflection of said tube.

7. A door stop and catch as recited in claim 6 wherein said base plate is mounted to a door and said strike plate is mounted to a wall.

8. A door stop and catch as recited in claim 1 wherein said flexible load transferring means is a chain.

9. A door stop and catch as recited in claim 1 wherein said flexible load transferring means is a cord.

10. A self-adjusting magnetic door stop and catch, comprising:

(a) a base plate mounted to a wall;

(b) a spring mounted to and projecting from said base plate, said spring having a plurality of helical coils around a longitudinal bore;

(c) a cable mounted to said base plate and extending through the longitudinal bore of said spring;

(d) a non-magnetic tube slidably positioned over the projecting portion of said spring;

(e) a magnet positioned within said tube, said magnet having a pair of bore holes opposite one another;

(f) a U-shaped wire mount having a notch formed at the center of its base and a pair of parallel projecting tines, each tine having an inwardly projecting pin inserted into a corresponding bore hole of said magnet;

(g) a two-eyed swivel connector having one eye mounted to said cable at the projecting and of said spring and the other eye looped around said U-shaped wire mount and fitted into said notch so as to allow the wire mount to swivel;

(h) a damping means fitted between said tube and the projecting end of said spring; and (i) a magnetically attractable plate mounted to a door opposite said magnet so as to attract and engage said magnet so as to hold said door in an open position.

11. A door stop and catch as recited in claim 10 wherein said base plate is mounted to a door and said strike plate is mounted to a wall.

12. A door stop and catch as recited in claim 11 wherein said damping means is a foam pad.

* * * * *